US005219721A

United States Patent [19]

Klaus et al.

[11] Patent Number: 5,219,721

[45] Date of Patent: Jun. 15, 1993

[54] SILVER HALIDE PHOTOGRAPHIC EMULSIONS SENSITIZED IN THE PRESENCE OF ORGANIC DICHALCOGENIDES

[75] Inventors: Roger L. Klaus, Rochester; Ingo H. Leubner, Penfield; Michael E. Ryan, Rochester, all of N.Y.

[73] Assignees: Eastman Kodak Company, Rochester, N.Y.;

[21] Appl. No.: 869,679

[22] Filed: Apr. 16, 1992

[51] Int. Cl.[5] ..... G03C 1/34

[52] U.S. Cl. ..... 430/569; 430/607; 430/608; 430/611

[58] Field of Search ..... 430/611, 607, 608, 546, 430/567, 569

[56] References Cited

U.S. PATENT DOCUMENTS

| | | | |
|---|---|---|---|
| T866,036 | 9/1969 | Kalenda et al. | 430/611 |
| 1,962,133 | 6/1934 | Brooker et al. | 430/611 |
| 2,465,149 | 3/1949 | Dersch et al. | |
| 2,756,145 | 7/1956 | Ballard et al. | 430/607 |
| 2,935,404 | 5/1960 | Dersch | 430/446 |
| 2,948,614 | 8/1960 | Allen et al. | 430/446 |
| 3,043,696 | 7/1962 | Herz et al. | 430/611 |
| 3,057,725 | 10/1962 | Herz et al. | 430/611 |
| 3,062,654 | 11/1962 | Allen et al. | 430/611 |
| 3,128,186 | 4/1964 | Corben et al. | 430/611 |
| 3,189,458 | 6/1965 | Herz | 430/600 |
| 3,226,232 | 12/1965 | Dersch et al. | 430/611 |
| 3,243,748 | 3/1966 | Lehmann et al. | 336/137 |
| 3,397,986 | 8/1968 | Millikan et al. | 430/603 |
| 3,409,437 | 11/1968 | Copeland et al. | 430/611 |
| 3,447,925 | 6/1969 | Dersch et al. | 430/423 |
| 3,563,754 | 2/1971 | Jones et al. | 430/570 |
| 3,637,393 | 1/1972 | Sakamoto et al. | 430/551 |
| 3,672,902 | 6/1972 | van Stappen et al. | 430/566 |
| 3,859,100 | 1/1975 | Kondo et al. | 430/600 |
| 3,926,632 | 12/1975 | Hofman et al. | 430/265 |
| 4,006,025 | 2/1977 | Swank et al. | 430/580 |
| 4,272,606 | 6/1981 | Mifune et al. | 430/264 |
| 4,468,454 | 8/1984 | Brown | 430/569 |
| 4,474,872 | 10/1984 | Onishi et al. | 430/512 |
| 4,521,508 | 6/1985 | Sugimoto et al. | 430/567 |
| 4,607,000 | 8/1986 | Gunther et al. | 430/428 |
| 4,740,438 | 4/1988 | Krishnamurthy | 430/17 |
| 4,741,990 | 5/1988 | Sakamoto et al. | 430/380 |
| 4,788,132 | 11/1988 | Deguchi et al. | 430/505 |
| 4,865,944 | 9/1989 | Roberts et al. | 430/139 |
| 4,865,947 | 9/1989 | Kuwabara et al. | 430/264 |
| 4,987,064 | 1/1991 | Saitou et al. | 430/570 |

FOREIGN PATENT DOCUMENTS

| | | |
|---|---|---|
| 2100622 | 7/1971 | Fed. Rep. of Germany . |
| 271187 | 8/1989 | German Democratic Rep. . |
| 62-58240 | 3/1987 | Japan . |
| 1013134 | 1/1989 | Japan . |
| 1105236 | 4/1989 | Japan . |

OTHER PUBLICATIONS

Research Disclosure, Item #29658 entitled "Photographic Silver Halide Emulsions Comprising Substituted Diphenyldisulphides", Dec. 1988, pp. 976–978, Kok et al.

*Primary Examiner*—Charles L. Bowers, Jr.
*Assistant Examiner*—Mark F. Huff
*Attorney, Agent, or Firm*—Sarah Meeks Roberts

[57] ABSTRACT

This invention provides a method of preparing a silver halide photographic emulsion which comprises adding to the silver halide emulsion before or during sensitization a non-labile chalcogen compound represented by Formula I:

$$R^1—X^1—X^2—R^2 \qquad \text{(Formula I)}$$

It further provides a silver halide photographic emulsion prepared by the above method.

20 Claims, No Drawings

SILVER HALIDE PHOTOGRAPHIC EMULSIONS SENSITIZED IN THE PRESENCE OF ORGANIC DICHALCOGENIDES

FIELD OF INVENTION

The present invention relates to light sensitive silver halide emulsions. In particular it relates to light sensitive silver halide emulsions sensitized in the presence of organic dichalcogenides.

BACKGROUND OF THE INVENTION

Problems with fogging have plagued the photographic industry from its inception. Fog is a deposit of silver or dye that is not directly related to the image-forming exposure, i.e., when a developer acts upon an emulsion layer, some reduced silver is formed in areas that have not been exposed to light. Fog can be defined as a developed density that is not associated with the action of the image-forming exposure, and is usually expressed as "Dmin", the density obtained in the unexposed portions of the emulsion. A density, as normally measured, includes both that produced by fog and that produced by exposure to light. It is known in the art that the appearance of photographic fog related to intentional or unintentional reduction of silver ion (reduction sensitization) can occur during many stages of preparation of the photographic element including silver halide emulsion preparation, (spectral) chemical sensitization of the silver halide emulsion, melting and holding of the liquid silver halide emulsion melts, subsequent coating of silver halide emulsions, and prolonged natural and artificial aging of coated silver halide emulsions.

Several methods have been employed to minimize this appearance of fog. Mercury containing compounds, such as those described in U.S. Pat. Nos. 2,728,663; 2,728,664; and 2,728,665, have been used as additives to combat fog. Thiosulfonate and thiosulfonate esters, such as those described in U.S. Pat. Nos. 2,440,206; 2,934,198; 3,047,393; and 4,960,689, have also been employed.

Aromatic, heterocyclic, and acyclic disulfides which do not have labile sulfur or sulfide, such as those described in U.S. Pat. Nos. 1,962,133; 2,465,149; 2,756,145; 3,043,696; 3,057,725; 3,062,654; 3,128,186; and 3,563,754, have been used primarily as emulsion melt additives, i.e. being introduced into already (spectral) chemically sensitized silver halide emulsions prior to coating. U.S. Pat. No. 3,397,986 discloses Bis(p-acylamidophenyl)disulfides as useful antifoggants added before or after any optically sensitizing dyes. However, the use of optically sensitizing dyes during chemical sensitization was not readily known in the art until their widespread use during tabular shaped silver halide emulsion sensitization. U.S. Pat. No. 3,397,986 and the others cited previously did not anticipate the utility of these non-labile disulfides during the sensitization of silver halide emulsions, either with or without optically sensitizing dyes. The prior art use of these disulfides as melt additives does decrease fog and stabilize against fog during aging of coated emulsions, but when used in this manner also decreases sensitivity and requires the use of additional stabilizers like azaindenes, such as described in U.S. Pat. No. 3,859,100.

There is a continuing need for improved methods of preventing fog in photographic elements without severely impacting sensitivity. In accordance with this invention, it has been found that the addition of a particular class of non-sensitizing dichalcogenides to a silver halide emulsion immediately before or during (spectral) chemical sensitization gives lower fog without a concomitant large loss in sensitivity. It has also been found that equivalent fog reduction can be obtained with much less dichalcogenide when the dichalcogenide is used during sensitization, rather than as a melt additive, and that less or no latent image destabilization occurs. Additionally, less loss in sensitivity occurs after aging of the coated emulsions.

SUMMARY OF THE INVENTION

This invention provides a method of making a photographic silver halide emulsion comprising precipitating and sensitizing a silver halide emulsion and adding to the silver halide emulsion before or during spectral/chemical sensitization an antifogging amount of a non-labile chalcogen compound represented by Formula I:

$$R^1—X^1—X^2—R^2 \qquad \text{(Formula I)}$$

where $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups.

In one embodiment the dichalcogenide compound is a disulfide compound represented by Formula II or III.

(Formula II)

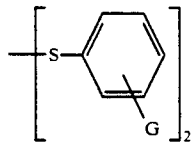

In formula II, G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen, or a substituted or unsubstituted alkyl or aryl group;

$R^4$ is hydrogen, O═C—$R^5$, or O═C—N—$R^6R^7$; and $R^5$, $R^6$, and $R^7$ are independently hydrogen, or hydroxy, or an unsubstituted alkyl, or aryl group, or a substituted or unsubstituted fluoroalkyl, fluoroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups.

(Formula III)

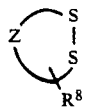

In formula III, Z contains substituted or unsubstituted carbon or hetero atoms sufficient to form a ring; and R8 is a substituted or unsubstituted alkyl or aryl group of 2 to 10 carbon atoms, or the free acid, alkaline earth salt, arylammonium or alkylammonium salt of the aforementioned groups.

In another embodiment the silver halide emulsion is a silver bromoiodide emulsion. The silver halide emulsion may also be a reduction sensitized emulsion. In a further embodiment the dichalogenide compound is added to the silver halide emulsion as a solid particle dispersion.

This invention further provides a photographic silver halide emulsion prepared by the method described above.

DETAILED DESCRIPTION OF THE INVENTION

The dichalogenic compounds of this invention are represented by Formula I.

$$R^1—X^1—X^2—R^2 \qquad \text{(Formula I)}$$

In the above formula $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups. Preferably the molecule is symmetrical and $R^1$ and $R^2$ are alkyl or aryl groups. Preferred is the combination of $R^1$ and $R^2$ resulting in a dichalcogenide with a molecular weight greater than 210 g/mol. $R^1$ and $R^2$ cannot be groups which cause the compound to become labile, such as for example,

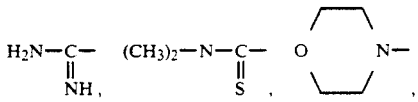

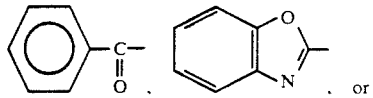

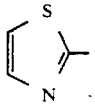

Some examples of preferred compounds are shown below.

EXAMPLES OF FORMULA I $R^1—X^1—X^2—R^2$

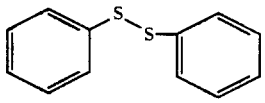

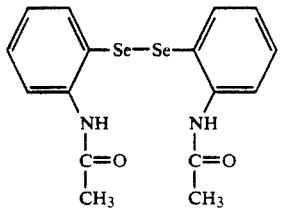

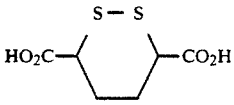

-continued

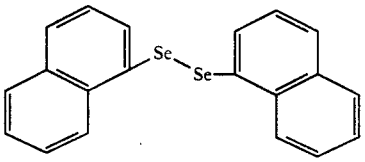

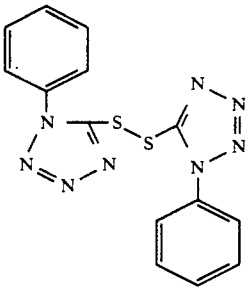

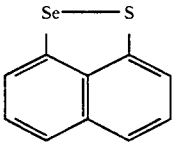

$HO_2C(CH_2)_4—Se—Se—(CH_2)_4CO_2H$

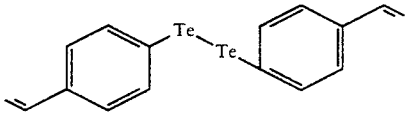

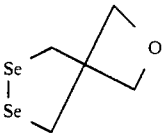

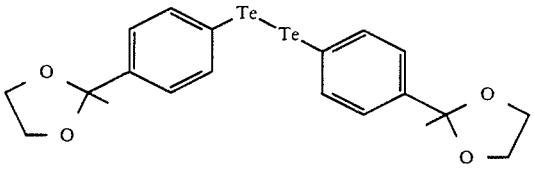

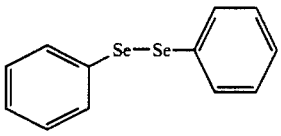

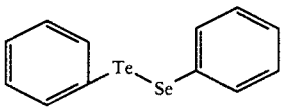

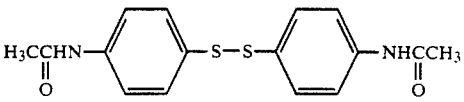

-continued

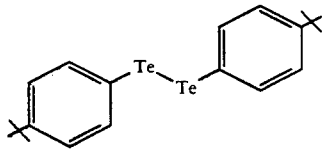

The dichalcogen must be non-labile meaning it does not release elemental chalcogen or chalcogen anion under specified conditions for making conventional photographic emulsions or the resulting photographic element.

Preferably the dichalcogenide compound is a disulfide compound represented by Formula II or III.

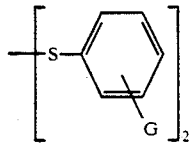

(Formula II)

In formula II, G is independently in an ortho, meta, or para position on the aromatic nucleus relative to the sulfur. More preferably the molecule is symmetrical and most preferably G is in the para position. G is hydrogen, hydroxy, $SO_3M$ or $NR^3R^4$. More preferably G is $NR^3R^4$.

M is hydrogen, or an alkaline earth, alkylammonium or arylammonium cation. Preferably M is hydrogen or sodium, and more preferably M is sodium. $R^3$ is hydrogen, or a substituted or unsubstituted alkyl or aryl group. Preferred substituents on the alkyl or aryl groups of $R^3$ may be methyl, amino, carboxy, or combinations thereof. The preferred groups contain up to 20 and more preferably up to 10 carbon atoms. Examples of suitable groups are trifluoromethyl, methyl, ethyl, propyl, phenyl, and tolyl.

$R^4$ is hydrogen, O=C—$R^5$, or O=C—N—$R^6R^7$. More preferably $R^4$ is hydrogen, or O=C—$R^5$.

$R^5$, $R^6$, and $R^7$ are independently hydrogen, or hydroxy, or an unsubstituted alkyl, or aryl group, or a substituted or unsubstituted fluoroalkyl, fluroaryl, carboxyalkyl, carboxyaryl, alkylthioether, arylthioether, sulfoalkyl, or sulfoaryl group or the free acid, alkaline earth salt or alkylammonium or arylammonium salt of the aforementioned groups. Examples of suitable groups are trifluoromethyl, methyl, ethyl, n-butyl, isobutyl, phenyl, naphthyl, carboxymethyl, carboxypropyl, carboxyphenyl, oxalate, terephthalate, methylthiomethyl, and methylthioethyl.

In a more preferred embodiment $R^3$ is a hydrogen or methyl and $R^4$ is O=C—$R^5$. $R^5$ is preferably an alkyl group of 1 to 10 carbon atoms, an aryl group of 6 to 10 carbon atoms or a trifluoromethyl group. Most preferably the disulfide compound is p-acetamidophenyl disulfide.

Examples of preferred disulfide compounds are listed in Table 1.

TABLE I

| Examples of Formula II* Designation; Position, and substituent structure of G | | |
|---|---|---|
| II-1 | para | $N(H)C(O)CH_3$ |
| II-2 | meta | $N(H)C(O)CH_3$ |
| II-3 | ortho | $N(H)C(O)CH_3$ |
| II-4 | para | $NH_2 \times HCl$ |

TABLE I-continued

| Examples of Formula II* Designation; Position, and substituent structure of G | | |
|---|---|---|
| II-5 | para | N(H)C(O)H |
| II-6 | ortho | N(H)C(O)H |
| II-7 | para | $N(H)C(O)CF_3$ |
| II-8 | ortho | $N(H)C(O)CF_3$ |
| II-9 | para | N(H)C(O)-phenyl |
| II-10 | para | N(H)C(O)-ethyl |
| II-11 | para | N(H)C(O)-propyl |
| II-12 | para | N(H)C(O)-naphthyl |
| II-13 | para | $N(H)C(O)C_7H_{15}$ |
| II-14 | para | $N(H)C(O)C_{14}H_{29}$ |
| II-15 | para | $N(H)C(O)C_{17}H_{35}$ |
| II-16 | para | $N(H)C(O)CH_2—S—C_{12}H_{25}$ |
| II-17 | para | $N(H)C(O)CH_2—S—CH_3$ |
| II-18 | para | $N(H)C(O)C_2H_4—S—CH_3$ |
| II-19 | para | $N(H)C(O)CH_2(CH_3)—S—CH_3$ |
| II-20 | para | N(H)C(O)-phenyl(2-$SO_3Na$) |
| II-21 | para | $N(H)C(O)C(CH_3)_3$ |
| II-22 | para | N(H)C(O)-phenyl(4-$CO_2CH_3$) |

*atoms in parentheses in structure indicate they are substituted to the atom on the left.

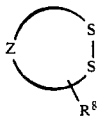

(Formula III)

In formula III, Z contains substituted or unsubstituted carbon or hetero atoms sufficient to form a ring. The preferred heteroatom is nitrogen. Most preferably Z contains all carbon atoms. Preferred substituents on Z may be, for example, methyl, ethyl, or phenyl groups. $R^8$ is a substituted or unsubstituted alkyl or aryl group of 2 to 10 carbon atoms, and more preferably 4 to 8 carbon atoms, or the free acid, alkaline earth salt, or the alkylammonium or arylammonium salt of the aforementioned groups. Preferably $R^8$ is a substituted or unsubstituted carboxyalkyl, carboxyaryl, alkyl ester, or aryl ester group. Examples of appropriate substituents include alkyl and aryl groups.

More preferably Z comprises four carbon atoms and $R^8$ is an alkyl or carboxyalkyl group of 4 to 8 carbon atoms, or the free acid, alkaline earth salt or ammonium salt of the aforementioned groups. The most preferred disulfide compound of general Formula III is 5-thioctic acid. Examples of Formula III are the following:

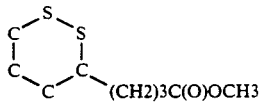

(III-1)

and

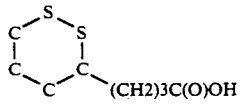

(III-2)

The dichalcogenide compounds of this invention can be prepared by the various methods known to those skilled in the art.

The optimal amount of the dichalcogenide compound to be added will depend on the desired final result, the type of emulsion, the degree of ripening, dichalcogenide structure and other variables. In general the concentration of dichalcogenide which is adequate is from about $1\times10^{-9}$ to about $1\times10^{-2}$ mol/mol Ag, with $1\times10^{-7}$ to $1\times10^{-2}$ mol/mol Ag being preferred and about $1\times10^{-5}$ to $3\times10^{-4}$ mol/mol Ag being most preferred. Surprisingly, when the dichalcogenide compounds are added as taught herein, the same antifogging response can be achieved with far less of the dichalcogenide compound than is required if the compounds are added as melt additives.

The dichalcogenide compounds of this invention can be added to the photographic emulsion using any technique suitable for this purpose. They can be added from solutions or as solids. For example, they can be dissolved in a suitable water miscible solvent and added directly to the silver halide emulsion as described in U.S. Pat. No. 3,397,986 or they can be added to the emulsion in the form of a liquid/liquid dispersion similar to the technique used with certain couplers. Examples of suitable solvents or diluents include methanol, ethanol, or acetone.

The most preferred method of addition is as a solid particle dispersion. Unexpectedly, it had been found that addition of the dichalcogenides using this method results in significantly greater antifogging activity. The aqueous, solid particle dispersions are prepared by milling an aqueous slurry of dichalcogenide and surfactant using known milling technology. Examples of suitable milling equipment include a ball mill and a SWECO mill. Descriptions of other general milling techniques which may be used with this invention may be found in Patton, Temple C. Paint Flow and Pigment Dispersion, Second Edition, Wiley-Interscience, New York, 1979, hereafter referred to as Patton.

Examples of milling media are zirconium oxide beads or silicon carbide sand. The milling temperature may be room temperature or slightly higher (<30° C.). Appropriate surfactants include, among others, Triton® X-200 (Rohm & Haas Company, Philadelphia, Pa.) an alkylated arylpolyether sulfonate and other anionic surfactants. The milled particles should be less than 1 micron.

Following milling, the slurry is separated from the media by coarse filtration. Generally the slurry is then diluted to working strength with a gelatin solution although it is not necessary to do so. As an alternative, the slurry can be used directly. Sonification may be used if necessary to break up aggregates. Alternatively the slurry and beads can be diluted into a gelatin solution and the beads separated from the final dispersion by coarse filtration. Characterization of the final dispersion for dichalcogenide content may be made by spectrophotometric analysis and for particle size by microscopy. For additional description of this technique see concurrently filed U.S. application Ser. No. 869,678 entitled "Aqueous, Solid Particle Dispersions of Dichalcogenides for Photographic Emulsions and Coatings", Boettcher et al., incorporated herein by reference.

Photographic emulsions are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum and diethylsenide; and polymeric agents, e.g., polyalkylene oxides. A temperature rise is employed to complete chemical sensitization (heat spike). Spectral sensitization is effected with agents such as sensitizing dyes. For color emulsions, dyes are added in the spectral sensitization step using any of a multitude of agents described in the art. It is known to add such dyes both before and after the heat spike.

After spectral sensitization, the emulsion is coated on a support. Various coating techniques include dip coating, air knife coating, curtain coating and extrusion coating.

In this invention the dichalcogenide compounds can be added anytime after precipitation and before or during the heat spike employed to affect chemical sensitization. This time frame is referred to herein as spectral/chemical sensitization. The dichalcogenide compounds may be added before or after the addition of sensitizers but preferably before the sensitizers. They can be added from the beginning or part-way-through the sensitization process. In one embodiment the emulsion is sensitized with sulfur and gold compounds as known in the art.

Combinations of the dichalcogenide compounds may be added i.e. two or more of Formula II or Formula III compounds, or a combination of Formula II and III compounds. The dichalcogenide compounds also may be added in combination with other antifoggants and finish modifiers.

The method of this invention is particularly useful with intentionally or unintentionally reduction sensitized emulsions. As described in *The Theory of the Photographic Process*, 4th edition, T. H. James, Macmillan Publishing Company, Inc., 1977, pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion).

During precipitation of a silver halide emulsion, unintentional reduction sensitization can occur when silver nitrate or alkali solutions are added rapidly or with poor mixing to form emulsion grains, for example. Also silver halide emulsions precipitated in the presence of ripeners (grain growth modifiers) such as thioethers, selenoethers, thioureas, or ammonia tend to facilitate reduction sensitization.

The reduction sensitized silver halide emulsions prepared as described in this invention exhibit good photographic speed but usually suffer from undesirable fog and poor storage stability.

Examples of reduction sensitizers and environments which may be used during precipitation or spectrochemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979).

Examples of processes for preparing intentionally reduction sensitized silver halide emulsions are described in EP 0 348934 A1 (Yamashita), EP 0 369491 (Yamashita), EP 0 371388 (Ohashi,), EP 0 396424 A1

(Takada), EP 0 404142 A1 (Yamada) and EP 0 435355 A1 (Makino).

The method of this invention is also particularly useful with emulsions doped with Group VIII metals such as iridium, rhodium, osmium and iron as described in *Research Disclosure,* December 1989, Item 308119, published by Kenneth Mason Publications, Ltd., Dudley Annex, 12a North Street, Emswirth, Hampshire P010 7DQ, ENGLAND. It is common practice in the art to dope emulsions with these metals for reciprocity control.

A general summary of the use of iridium in the sensitization of silver halide emulsions is contained in Carroll, "Iridium Sensitization: A Literature Review," Photographic Science and Engineering, Vol. 24, No. 6, 1980.

A method of manufacturing a silver halide emulsion by chemically sensitizing the emulsion in the presence of an iridium salt and a photographic spectral sensitizing dye is described in U.S. Pat. No. 4,693,965. The low intensity reciprocity failure characteristics of a silver halide emulsion may be improved, without significant reduction of high intensity speed, by incorporating iridium ion into the silver halide grains after or toward the end of the precipitation of the grains is described in U.S. Pat. No. 4,997,751. The use of osmium in precipitating an emulsion is described in U.S. Pat. No. 4,933,272 (McDugle).

In some cases when such dopants are incorporated, emulsions show an increased fresh fog and a lower contrast sensitometric curve when processed in the color reversal E-6 process as described in The British Journal of Photography Annual, 1982, pages 201-203.

The iridium doped emulsions of this invention sensitized with disulfide present during the sensitization showed a dramatic decrease in fresh fog and higher contrast. The high temperature storage stability of the unexposed film was also improved by the practice of this invention by reducing the change in speed.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain among other things brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed but before uniformly fogging the emulsion the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

The following compounds are utilized in the Examples.

Compound II-1 = p-acetamidophenyl disulfide

Compound A = anhydro-5'-chloro-3,3'-bis(3-sulfopropyl)naphtho{1,2-d}oxazolothiacyanine hydroxide triethylamine Compound B = 4-hydroxy-6-methyl-1,3,3a,7-tetraazaindene Compound C = Benzoic acid, 4-chloro-3-{(2-(4-ethoxy-2,5-dioxo-3-(phenyl)methyl-1-imidazolidinyl)-4,4'-dimethyl-1,3-dioxopropyl)amino)dodecyl ester Compound D = sodium thiocyanate Compound E = 3-methyl benzothiazolium iodide Compound F = sodium thiosulfate pentahydrate Compound G = potassium tetrachloroaurate Compound H =

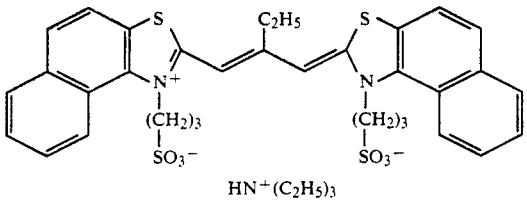

Compound I =

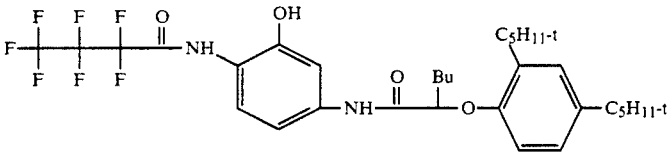

Hexanamide, 2-[2,4-bis(1,1-dimethylpropyl)phenoxy]-N-[4-[(2,2,3,3,4,4,4-heptafluoro-1-oxobutyl)amino]-3-hydroxyphenyl]-

Compound III-2 = 5-thioctic acid

Compound J = sodium aurous (I) dithiosulfate dihydrate

Compound K = anhydro-9-ethyl-5,5'-dimethyl(-3,3'-di(3-disulfopropyl)thiacarbocyanine hydroxide triethylamine salt Compound L = anhydro-9-ethyl-5,5'-dichloro-3,3'-bis-(2-hydroxy-3-sulfopropyl) thiacarbocyanine hydroxide sodium salt Compound II-3 = o-acetamidophenyl disulfide Compound II-5 = p-formamidophenyl disulfide Compound II-6 = o-formamidophenyl disulfide Compound II-7 = p-trifluoroacetamidophenyl disulfide Compound II-8 = o-trifluoroacetamidophenyl disulfide Compound M = anhydro-9-ethyl-5',6'-dimethoxy-5-phenyl-3-(3-sulfobutyl)-3-(3-sulfopropyl)oxathiacarbocyanine hydroxide sodium salt Compound N = anhydro-5,5'-dichloro-9-ethyl-3,3'-di(3-sulfopropyl)thiacarbocyanine hydroxide triethylamine salt Compound O = 3-(2-methylsulfamoylethyl)-benzothiazolium tetrafluoroborate Compound P =

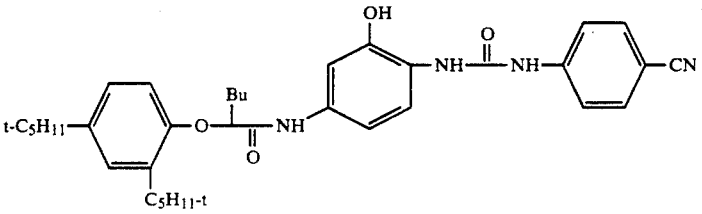

Hexanamide, 2-[2,4-bis(1,1-dimethylpropyl)phenoxy]-N-[4-[[[(4-cyanophenyl)amino]carbonyl]amino]-3-hydroxyphenyl]-

-continued

Compound Q =

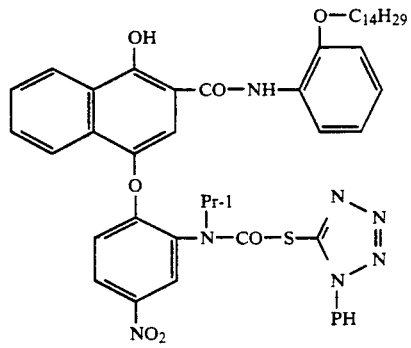

EXAMPLE 1

An iridium doped, 1.6-μm 2% iodide silver bromoiodide emulsion (Emulsion A) was precipitated by adding to a precipitation vessel 6.72 L of a water solution containing 546.4 g sodium bromide, 26.72 g potassium iodide, and 248 g bone gelatin. The solution was stirred at 40° C. and with a pH of 5.77. The temperature was increased to 79° C. A 1.5 molar silver nitrate solution was added through a jet at a constant flow for 41 minutes with 8 moles of silver added. A 3 molar sodium bromide solution was added through a second jet at varying flow rates for 41 minutes with 2.9804 moles of bromide added.

At the end of the silver run and at 52° C., 100 ml aqueous ammonium sulfate solution (0.167 g/ml) was added. $K_2IrCl_6$ at a concentration of $6.7\times10^{-7}$ mol/Ag mol was added into the vessel, which was then digested for 5 minutes by addition of 6.5 ml/Ag mol of a 15 normal ammonium hydroxide solution, followed by pH adjustment to 6.0 at 40° C. Due to the ammonia digestion, this emulsion is prone to reduction sensitization fog. Emulsion A was sensitized with sulfur, gold and blue spectral sensitizer Compound A. Emulsion B was prepared like Emulsion A, but for comparison, 24.4 mg and 90.0 mg of Compound II-1 were added form methanolic solution separately per mol Ag to the spectrochemically sensitized emulsion prior to coating as practiced in U.S. Pat. No. 3,397,986.

Emulsion C (invention) was prepared by adding 24.4 mg Compound II-1/Ag mol from methanolic solution to the unsensitized emulsion before spectrochemical sensitization as with Emulsion A.

COATING, EXPOSURE, AND DEVELOPMENT

Eighty-nine mg/ft$^2$ of the sensitized emulsions was coated with 1.75 g/Ag mol of Compound B as a stabilizer, 180 mg/ft$^2$ of yellow coupler Compound C, and 220 mg/ft$^2$ of gelatin over an anithalation support. The emulsion layer was protected by a gelatin overcoat and hardened. The coatings were exposed for 1 second with 3200K through a step wedge and Kodak Wratten filter Wr2B on a 1B sensitometer. They were processed for six minutes in a color reversal E-6 process to form positive images. The speed (reversal) was determined at 0.3 below Dmax (maximum density). Fog was determined by developing a black and white image for four minutes followed by forming a negative color image as described previously for reversal process. After fresh testing, coatings were kept at 120° F. and 50% relative humidity for 2 weeks for testing storage stability. Change in Dmax and speed due to the keeping condition was expressed as %Dmax and Dspeed. LIK is the speed change after exposure when kept at 78° F., 50% relative humidity for 2 weeks.

TABLE II

| Emulsion | Addition | Compound II-1* | Fog | Dmax | Speed | Contrast | % Dmax | DSpeed | LIK |
|---|---|---|---|---|---|---|---|---|---|
| A | none | 0.0 | 1.63 | 0.15 | — | — | — | — | — |
| B | melt | 24.4 | 1.61 | 0.21 | — | — | — | — | — |
| B | melt | 90.0 | 1.59 | 0.23 | — | — | — | — | — |
| C | senst | 24.4 | 0.15 | 1.67 | 94 | −48 | −5 | −25 | −7 |

— No measurable images because of excessively high fog.
*in mg/Ag

CONCLUSION

Unless Compound II-1 was incorporated during chemical sensitization, fog was not significantly reduced. Because of high fog, speed, contrast, storage stability, and latent image (LIK) speed changes were not measurable unless Compound II-1 was used during sensitization. A level of Compound II-1 effective during sensitization was not effective when added after sensitization.

EXAMPLE 2

A 0.44-μm, 2% iodide silver bromoiodide emulsion (Emulsion D) was prepared by adding to a precipitation vessel 8.539 L of a water solution that was 6.94 molar sodium bromide, 0.2 molar potassium iodide and contained 2.76 percent bone gelatin. The solution was stirred at 40° C. and at pH 5.42. The temperature was increased to 52° C.

A 2.5 molar silver nitrate solution was added through a jet at a constant flow rate for 27.77 minutes with 10.0 moles of silver added. At 16.67 minutes into the silver run, a 3 molar NaBr solution was added through a second jet at variable flow rates for 8.33 minutes with 1.039 moles of bromide added.

A solution of $K_2IrCl_6$ in $HNO_3$ was added after 90% of the total silver addition. Ammonia digestion was not used. The emulsion was sensitized with 42 mg Compound D, 22 mg Compound E, 7.0 mg Compound F, and 3.5 mg Compound G (all per mol Ag) at 70° C. for 20 minutes. Compound II-1 was added from a methanolic solution before the sulfur and gold sensitizers in the invention examples as compared to the control examples as taught by U.S. Pat. No. 3,397,986 where Compound II-1 was added after sensitization. After chemical sensitization, 370 mg/mole Ag of Compound H was added.

COATING, EXPOSURE, AND DEVELOPMENT

Seventy-five mg/ft$^2$ of the sensitized emulsions was coated with 1.75 g/Ag mol of Compound B as stabilizer, 150 mg/ft$^2$ of cyan coupler Compound I, and 220 mg/ft$^2$ of gelatin over an antihalation support. The emulsion layer was protected by a gelatin overcoat and hardened. The coatings were exposed for 0.1 second with 3200K through a step wedge and Kodak Wratten filter Wr29 with 0.6 neutral density filter on a 1B sensitometer. The development, incubation, and evaluation conditions followed those in Example 1.

TABLE III

| Compound II-1 mg/Ag mol | Fresh Sensitometry Fog Inv. | Fog Contr. | SPD Inv. | SPD Contr. |
|---|---|---|---|---|
| 0.0 | 0.47 | 0.51 | 247 | 250 |
| 1.6 | 0.43 | 0.41 | 250 | 248 |
| 4.0 | 0.39 | 0.47 | 254 | 246 |
| 8.0 | 0.24 | 0.36 | 247 | 249 |
| 12.2 | 0.20 | 0.28 | 239 | 247 |
| 24.4 | 0.09 | 0.20 | 213 | 237 |
| 90.0 | 0.05 | 0.12 | 121 | 215 |

| Compound II-1 mg/Ag mol | Sensitometry after Incubation % Dmax Inv. | % Dmax Contr. | D Speed Inv. | D Speed Contr. |
|---|---|---|---|---|
| 0.0 | −88 | −86 | −247 | −250 |
| 1.6 | −87 | −85 | −250 | −248 |
| 4.0 | −83 | −87 | −254 | −246 |
| 8.0 | −74 | −85 | −74 | −249 |
| 12.2 | −65 | −81 | −50 | −131 |
| 24.4 | −34 | −67 | −22 | −49 |
| 90.0 | −2 | −36 | −23 | −9 |

* at 90 mg, speed loss measurably degraded

Compound II-1 when added in the sensitization provided significant reductions in fresh fog without large speed loss, and significantly less fog growth (less %Dmas loss) as well as less speed and Dmax losses when coatings were stored at 120 degrees F. and 50% relative humidity for 2 weeks. These same effects were obtained with Compound II-1 added after sensitization but only at higher concentrations.

EXAMPLE 3

A high speed, 1.6-μm octahedral core/shell structured silver bromoiodide emulsion (Emulsion E) was prepared which contained 20% iodide in the core and 0% iodide in the shell by ripening at high pH with ammonia. Emulsion E (comparison) was sensitized with 4 mg Compound G per Ag mol at 65° C. for 40 minutes. Emulsion F (invention) was sensitized like Emulsion E but 0.3 mmol of Compound III-2 per Ag mol was added from a methanolic solution prior to Compound G and heat treatment. The emulsion samples were then mixed with a conventional surfactant and hardener and coated on cellulose acetate, to give 300 mg Ag/ft$^2$ and 500 mg gelatin/ft$^2$, dried, exposed in a stepwise fashion for 0.02 s, and processed for 18 minutes in Kodak rapid x-ray developer.

TABLE IV

| Condition | Relative Speed | Fog |
|---|---|---|
| Comparison | 100 | 0.71 |
| Invention | 83 | 0.31 |

These results show that when used during sensitizations, Compound III-2 allows lower fog and sensitivity compared to in its absence. These effects are similar to those seen when Compound III-2 is used after sensitization, such as in U.S. Pat. Nos. 2,948,614 and 3,859,100; but when used during sensitization, much lower concentrations can be employed. Those skilled in the art can optimize concentration to give low fog without loss in sensitivity.

EXAMPLE 4

A slow speed, 0.3-μm octahedral silver bromide emulsion (emulsion G) was prepared in a conventional manner. This emulsion was split into portions and mixed with varying concentrations of stannous chloride (Sn). Methanolic solutions of Compound III-2 were added to the emulsion portions containing 0.1 mg/Ag mol of stannous chloride. All emulsion portions were then sensitized with 4 mg Compound F/Ag mol and 4 mg Compound G/Ag mol at 70° C. for 40 minutes. After mixing with a conventional surfactant and hardener, the emulsion were coated on cellulose acetate, to give 300 mg Ag/ft$^2$ and 400 mg gelatin/ft$^2$ dried, exposed for 0.2 second through a step density tablet, and processed for 6 minutes in MAA-1 developer, described in James, Vanselow and Quirk, Photographic Science Technology, 19B:170 (1953). Levels of compounds per Ag mol.

TABLE V

| Sn* (mg) | Compound III-2* (mmol) | Relative Speed | Fog | Changes after 1 week at 120 F. Relative Speed | Fog |
|---|---|---|---|---|---|
| 0 | 0 | 100 | 0.028 | +82 | +0.031 |
| 0.025 | 0 | 118 | 0.044 | +73 | +0.031 |
| 0.050 | 0 | 148 | 0.146 | +66 | +0.123 |
| 0.075 | 0 | 191 | 0.504 | +28 | +0.427 |
| 0.100 | 0 | 186 | 0.837 | +18 | +0.567 |
| 0.100 | 1 | 145 | 0.151 | +33 | +0.144 |
| 0.100 | 5 | 65 | 0.041 | +6 | +0.018 |

*added per mol Ag

These data show the expected increase in sensitivity and fog from a reducing agent (Sn) in a sulfur-plus-gold sensitization. These increases in sensitivity are accompanied by undesirable increases in fog growth after aging. The use of Compound III-2 during sensitization in the presence of a reducing agent gives better control over sensitivity and fog and their changes after aging. Selection of appropriate concentrations of sensitization components by one skilled in the art can result in desired sensitivity and fog with minimal changes after aging.

EXAMPLE 5

A 0.56-μm×0.083-μm 4% iodide, silver bromoiodide tabular emulsion (Emulsion H) was sensitized with 0.185 g Compound D/Ag mol, 6.6 mg Compound J/Ag mol, 6.2 mg Compound F/Ag mol, 0.88 g Compound K/Ag mol and 0.088 g Compound L/Ag mol by holding at 61° C. for 15 minutes. The resulting sensitized emulsion was mixed with additional water and gelatin in preparation for coating. A secondary melt composed of gelatin, Compound I, and coating surfactants was mixed in equal volumes with the emulsion melt immediately before coating on a cellulose acetate support. This emulsion layer was then protected by a gelatin overcoat and hardened. The resulting dried coatings containing 75 mg silver/ft$^2$, 220 mg gelatin/ft$^2$, and 144 mg Compound I/ft2 were exposed for 0.02 s through a stepped density tablet and 0.3 density Inconel and Kodak Wratten 23A filters with 500K light. Exposed strips were then developed in either E-6 color reversal developer to obtain a reversal color image or a black and white developer followed by forming a negative color image with a color reversal process as described previously.

EXAMPLE 6

Emulsion H (comparison) was sensitized as described in Example 5. Emulsion I (invention) was sensitized like Emulsion H but Compound III-2 was added at 0.1 mmol/Ag mol from a methanolic solution immediately before sensitizers. Emulsion J (invention) was sensitized like Emulsion I but Compound III-2 was added at 1.0 mmol/Ag mol. Emulsions H, I, and J were prepared for coating as described in Example 5 but with 1.75 g Compound B/Ag mol added prior to coating. Emulsions K, L, and M (comparisons) were prepared like Emulsion H but contained 0.1, 1.0, and 10.0 mmol/Ag mol, respectively, of Compound III-2 added from methanolic solution prior to coating just before Compound B. Resulting coatings were dried and exposed before processing to give a negative color image as described in Example 5.

TABLE VI

| Emulsion | Compound III-2 (mmol/mol Ag) | Relative Speed | Fog |
|---|---|---|---|
| H (comparison) | 0 | 100 | 0.533 |
| I (invention) | 0.1 | 107 | 0.433 |
| J (invention) | 1.0 | 100 | 0.241 |
| K (comparison) | 0.1 | 97 | 0.493 |
| L (comparison) | 1.0 | 95 | 0.435 |
| M (comparison) | 10.0 | 85 | 0.266 |

These results show that when used during the spectrochemical sensitization, Compound III-2 allows lower fog without reduction in sensitivity than when it is used after the sensitization as an emulsion melt additive. The data show that less Compound III-2 can be used in the sensitization to achieve a more desirable effect.

EXAMPLE 7

Emulsion H (comparison) was sensitized as described in Example 5. Emulsions N and 0 (inventions) were sensitized like Emulsion H but Compound II-1 was added at 0.01 and 0.1 mmol/Ag from methanolic solution immediately before sensitizers.

Emulsions P and Q (inventions) were prepared similar to Emulsions N and 0 but Compound II-3 was used instead of Compound II-1.

Emulsions R and S (inventions) were prepared similar to Emulsions N and 0 but Compound II-8 was used instead of Compound II-1.

Emulsions T and U (inventions) were prepared similar to Emulsions N and 0 but Compound II-6 was used instead of Compound II-1.

Emulsions V and W (inventions) were prepared similar to Emulsions N and 0 but Compound II-7 was used instead of Compound II-1.

Emulsions X and Y (inventions) were prepared similar to Emulsions N and 0 but Compound II-5 was used instead of Compound II-1.

The emulsions were then prepared for coating as in Example 5. The dried and exposed coatings were then developed in E-6 reversal process. A high D-max is desirable.

TABLE VII

| Emulsion | Compound | D-max | Relative Speed |
|---|---|---|---|
| H | — | 2.30 | 100 |
| N | II-1 | 2.56 | 115 |
| O | II-1 | 2.79 | 43 |
| P | II-3 | 2.39 | 112 |
| Q | II-3 | 2.76 | 57 |
| R | II-8 | 2.39 | 123 |
| S | II-8 | 2.79 | 52 |
| T | II-6 | 2.50 | 120 |
| U | II-6 | 2.76 | 42 |
| V | II-7 | 2.48 | 118 |
| W | II-7 | 2.73 | 37 |
| X | II-5 | 2.49 | 123 |
| Y | II-5 | 2.77 | 44 |

These data show that when used in the sensitization, the disulfides of Formula II give good D-max with no loss in sensitivity. At higher concentrations, sensitivity decreased as expected. This level of control over sensitivity loss with good D-max is difficult to attain when the disulfides of Formula II are used as melt additives.

EXAMPLE 8

Emulsion H (comparison) was sensitized as in Example 5. Emulsion MS (invention) was prepared similar to Emulsion N in Example 7 but Compound II-1 was added at 5 mg/Ag mol.

Emulsion SS (invention) was prepared similar to Emulsion MS but Compound II-1 was added as a solid particle suspension in gelatin. This suspension was prepared as follows:

Into a 950 cc brown bottle was placed 1600 g of 1.8 mm zirconium oxide milling media. A slurry of 14.25 g of Compound II-1, 31.5 g of Triton® X-200 solution and 144.25 g of water was then added. The bottles of media and slurry were then rotated on a ball mill for 6 days at 91 rpm. Following milling, the media were separated from the slurry using a coarse mesh screen and the dispersion diluted with a solution of deionized bone gelatin and water to achieve a concentration of 1.5% gelatin and 6.0% gelatin. Microscopy showed all the dispersions to have disulfide particle sizes of less than one micron. A relative but quantitative measure of particle size can be obtained by measuring the absorbance of the sample due to its turbidity. A dispersion such as the one in this example when diluted to 0.15% disulfide and 3.0% gelatin and measured at 500 nm in a 0.10 mm cell gives an absorption from 0.14 to 0.25.

Emulsion MM (comparison) was similar to Emulsion H except that Compound II-1 was added after sensitization prior to coating from a methanolic solution at 50 mg/Ag mol.

Emulsion SM (comparison) was similar to Emulsion MM except that Compound II-1 was added as a solid particle suspension in gelatin.

Emulsions H, MS, SS, MM, and SM were prepared for coating as in Example 5.

Following drying, the coatings were exposed and processed to give a negative color image as described in Example 5.

TABLE VIII

| Emulsion | Compound II-1* Addition | Relative Speed | Fog |
|---|---|---|---|
| H | — | 100 | 0.550 |
| | 5 mg | | |
| MS | methanol | 105 | 0.282 |
| SS | solid dispersion | 73 | 0.230 |
| | 50 mg | | |
| MM | methanol | 110 | 0.406 |
| SM | solid dispersion | 95 | 0.268 |

*per Ag mol

These data show the greater prevention of fog without loss in sensitivity from Compound II-1 when used in the sensitization at 10 times less concentration than used after sensitization. The data also show that when introduced into the emulsion as a gelatin suspension, greater activity results compared to the corresponding methanol solution. The appropriate level of disulfides of Formula II or Formula III added from a gelatin suspension can be found by one skilled in the art.

EXAMPLE 9

A cubic, 0.5 mol % iodide, silver bromoiodide emulsion with mean edge length of 0.21 μm (Emulsion Z, comparison) was spectrochemically sensitized by adding at 40° C. (all components added per Ag mol):

| | |
|---|---|
| 0.2124 g | Compound M |
| 0.4506 g | Compound N |
| 0.0071 g | Compound F |
| 0.0142 g | Compound J |
| 0.06 g | Compound O, |

then heating for 15 minutes at 60° C. Following this finish time, the emulsion was cooled to 40° C. and 1.75 g Compound B was added per Ag mol.

Emulsion Z1 (invention) was similar to Emulsion Z except Compound II-1 was added to the emulsion at a level of 3.325 mg/Ag mol from a methanolic solution after the addition of Compound O but before raising the temperature to 60° C.

Emulsion Z2 (invention) was similar to Emulsion Z1 except Compound II-1 was added to the emulsion at a level of 8.312 mg/Ag mol.

Emulsion Z3 (invention) was similar to Emulsion Z1 except Compound II-1 was added to the emulsion at a level of 16.625 mg/Ag mol.

Emulsions Z, Z1, Z2, and Z3 were then mixed with additional gelatin and water in preparation for coating. Each emulsion was co-mixed with conventional gelatin-oil dispersions of Compound P and Compound Q. The cooled emulsion layer was protected by a gelatin overcoat containing conventional coating surfactants and hardened with bis(vinylsulfonylmethyl) ether.

The resulting coatings contained 870.3 mg Ag/m$^2$, 3,229.2 mg gelatin/m$^2$, 969 mg Compound P/m$^2$, and 26.9 mg Compound Q/m$^2$.

After hardening, the dried coatings were exposed through a graduated density tablet using a 5500K light source for 0.02 second, filtered with a Kodak Wratten 29 separation filter. Exposed coating were processed for 3 minutes, 15 second in C-41 color negative process.

TABLE IX

| Emulsion | Fresh Dmin | RSK* Delta Dmin |
|---|---|---|
| Z | 0.185 | 0.01 |
| Z1 | 0.175 | 0.008 |
| Z2 | 0.156 | 0.007 |
| Z3 | 0.149 | 0.005 |

*RSK delta is the difference between a coating kept 1 week at 120° C. and 50% relative humidity and a check coating kept 1 week at 0° C. and 50% relative humidity; then exposed and processed The data of Table IX show that the emulsions sensitized with Compound II-1 produce lower fresh fog levels than the control emulsion. Fog levels after RSK are also lower when Compound II-1 is present in the sensitization.

EXAMPLE 10

Emulsion ZA (comparison) was similar to Emulsion Z in Example 9 except that the hold time at 60° C. during sensitization is 25 minutes.

Emulsion ZA1 (invention) is similar to Emulsion Z1 in Example 9 except that the Compound II-1 level is $3.325\times10^{-5}$ g/Ag mol and the hold time at 60° C. is 25 minutes.

Emulsion ZA2 (invention) is similar to Emulsion ZA1 except that the Compound II-1 level is $3.325\times10^{-4}$ g/Ag mol.

Emulsion ZA3 (invention) is similar to Emulsion ZA1 except that the Compound II-1 level is $3.325\times10^{-3}$ g/Ag mol.

Emulsion ZA4 (invention) is similar to Emulsion ZA1 except that the Compound II-1 level is $8.313\times10^{-3}$ g/Ag mol.

Emulsions ZA, ZA1, ZA2, ZA3, and ZA4 were prepared for coating; coated, exposed, and processed as in Example 9.

TABLE X

| Emulsion | Fresh Dmin | RSK Delta Dmin |
|---|---|---|
| ZA | 0.162 | 0.01 |
| ZA1 | 0.161 | 0.006 |
| ZA2 | 0.163 | 0.007 |
| ZA3 | 0.150 | 0.007 |
| ZA4 | 0.145 | 0.005 |

The data in Table X indicate a preferred operating range for Compound II-1 in the sensitization of this silver bromoiodide emulsion in these elements between $3.325\times10^{-3}$ and $8.313\times10^{-3}$ g/Ag mol. Whereas lower levels of Compound II-1 do not significantly decrease fresh D-min, they do diminish the D-min changes after RSK.

EXAMPLE 11

Emulsion Z1 from Example 9 was coated in the Least Red Sensitive Layer (Layer 3) of the photographic film of this example. A three color photographic film was prepared as follows using conventional surfactants, antifoggants and the materials indicated. After providing a developable image and then processing in accordance with the Kodak C-41 process (British Journal of Photographic, pp. 196–198 (1988)) excellent results e.g. improved color, sharpness, granularity and neutral scale, were obtained. All silver halide emulsions were stabilized with 1.75 gm 4-hydroxy-6-methyl-1,3,3a,7-tetraazaindene per mole of silver. All silver halide emulsions were sensitized with the appropriate spectral red, green and blue sensitizing dyes.

| Support | mg/m² | mg/ft² | |
|---|---|---|---|
| Layer 1 | | | |
| Antihalation Layer | 215 | 20 | Black colloidal silver |
| | 91 | 8.5 | UV absorbing dye coupler (1) |
| | 91 | 8.5 | UV absorbing dye coupler (2) |
| | 14.3 | 13 | Blue filter dye (11) |
| | 2422 | 225 | Gelatin |
| Layer 2 | | | |
| Interlayer | 54 | 5.0 | D-Ox scavenging coupler (3) |
| | 861 | 80.0 | Gelatin |
| Layer 3 | | | |
| Least Red Sensitive Layer | 915 | 85 | Red sensitized silver iodobromide emulsion (4.5% iodide, tabular grains with average grain diameter 1.1 micron and average grain thickness 0.1 micron), |
| | 1238 | 115 | red sensitized silver iodobromide emulsion (0.5% iodide, cubic grains with average edge length 0.21 microns) |
| | 603 | 56 | Cyan dye forming image coupler (4) |
| | 36 | 3.3 | Cyan dye-forming development inhibitor release (DIR) coupler (5) |
| | 86 | 8.0 | Yellow dye-forming image coupler (6) |
| | 3078 | 286 | Gelatin |
| Layer 4 | | | |
| Most Red-Sesnsitive Layer | 1291 | 120 | Red sensitized silver iodobromide emulsion (3% iodide, octahedral grains with average grain diameter 0.90 micron) |
| | 54 | 5.0 | Cyan dye-forming image coupler (4) |
| | 32.3 | 3 | Cyan dye-forming masking coupler (7) |
| | 50 | 4.6 | Cyan dye-forming DIR coupler (9) |
| | 11 | 1.0 | Yellow dye-forming image coupler (6) |
| | 2368 | 220 | Gelatin |
| | 4.3 | 0.4 | Cyan dye-forming DIR coupler (8) |
| Layer 5 | | | |
| Interlayer | 129 | 12 | Oxidized development scavenger coupler (3) |
| | 861 | 80 | Gelatin |
| | 11 | 1 | Green filter dye (10) |
| | 49 | 4 | Blue filter dye (11) |
| Layer 6 | | | |
| Least Green-Sensitive Layer | 124 | 15 | Green sensitized silver iodobromide emulsion (3% iodide, tabular grains with average grain diameter 0.8 micron, and average grain thickness 0.1 micron) |
| | 592 | 55.0 | Green sensitized silver iodobromide emulsion (0.5% iodide, tabular gains with average grain diameter 0.5 and average grain thickness 0.1 micron) |
| | 161 | 15.0 | Magenta dye-forming image coupler that releases a bleach accelerating fragment (12) |
| | 12 | 1.1 | magenta dye-forming DIR coupler (13) |
| | 1507 | 140 | Gelatin |
| Layer 7 | | | |
| Mid Green-Sensitive Layer | 969 | 90.0 | Green sensitized silver iodobromide emulsion (3% iodide, tabular grains with average grain diameter 0.8 micron and average grain thickness 0.1 micron) |
| | 75.0 | 7.0 | Magenta dye-forming image coupler (14) |
| | 54.0 | 5.0 | Magenta dye-forming image coupler (15) |
| | 9.0 | 0.8 | Magenta dye-forming DIR coupler (13) |
| | 11.0 | 1.0 | Cyan dye forming, image coupler (4) |
| | 1238 | 115.0 | Gelatin |
| Layer 8 | | | |
| Most Green-Sensitive Layer | 753.0 | 70.0 | Green sensitized silver iodobromide emulsion (6% iodide, tabular grains with average grain diameter 1.0 micron and average grain thickness 0.1 micron) |
| | 22.0 | 2.0 | Magenta dye-forming image coupler (15) |
| | 13.0 | 1.2 | Magenta dye-forming DIR coupler (13) |
| | 65.0 | 6.0 | Magenta dye-forming development masking coupler (16) |
| | 26.0 | 2.4 | Yellow dye-forming DIR coupler (17) |
| | 969 | 90.0 | Gelatin |
| Layer 9 | | | |
| Interlayer | 75.0 | 7.0 | D-Ox scavenging coupler (3) |
| | 194.0 | 18.0 | Developer bleachable yellow filter dye (18) |
| | 861.0 | 80.0 | Gelatin |
| Layer 10 | | | |
| Least Blue-Sensitive Layer | 215.0 | 20.0 | Blue sensitized silver iodobromide emulsion (6% iodide, octahedral grains with average grain diameter of 0.65 micron) |
| | 129.0 | 12.0 | Blue sensitized silver iodobromide emulsion (5% iodide, octahedral grains with average grain diameter of 0.40 micron) |
| | 258.0 | 24.0 | Blue sensitized silver iodobromide emulsion (5% iodide, octahedral grains with average grain diameter of 0.23 micron) |
| | 11.0 | 97.0 | Yellow dye-forming image coupler (19) |
| | 1420 | 132.0 | Gelatin |
| Layer 11 | | | |
| Most Blue-Sensitive Layer | 377.0 | 35.0 | Blue sensitized silver iodobromide emulsion (6% iodide, octahedral grains with average grain diameter of 1.0 micron) |
| | 11.0 | 1.0 | Yellow dye-forming DIR coupler (17) |

-continued
| Support | mg/m² | mg/ft² | |
|---|---|---|---|
| | 1076 | 100.0 | Gelatin |
| Layer 12 | | | |
| First Protective Layer | 215.0 | 20.0 | Unsensitized silver bromide Lippman emulsion (0.04 microns) |
| | 108.0 | 10.0 | UV absorbing dye (1) |
| | 129.0 | 12.0 | UV absorbing dye (2) |
| | 753.0 | 70.0 | Tricresyl phosphate |
-continued
| Support | mg/m² | mg/ft² | |
|---|---|---|---|
| | 1345 | 125.0 | Gelatin |
| | 40 | 0.4 | Green absorbing dye (10) |
| | 20 | 0.2 | Red absorbing dye (20) |
| Layer 13 | | | |
| Second Protective Layer | 44.0 | 4.1 | Matte polyvinyltoluene beads |
| | 883.0 | 82.0 | Gelatin |
Coupler/Dye Structures
(1)
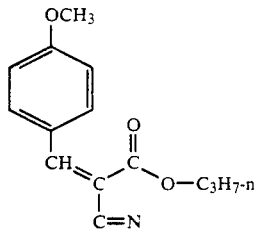
(2)
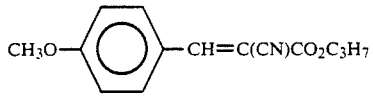
(3)
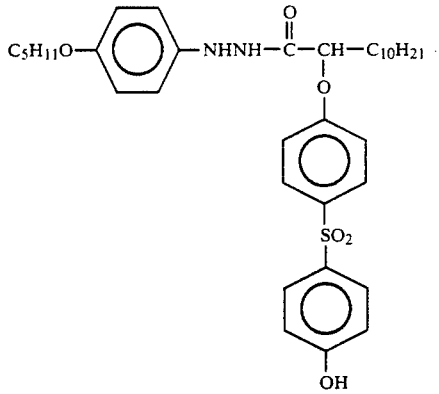
(4)
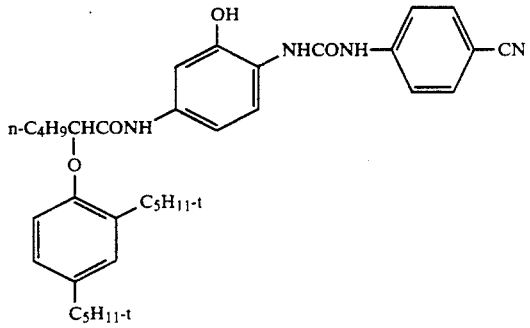

-continued
Coupler/Dye Structures
(5)
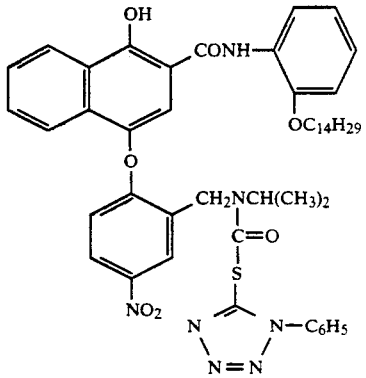
(6)
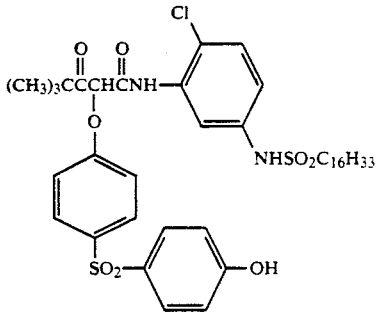
(7)
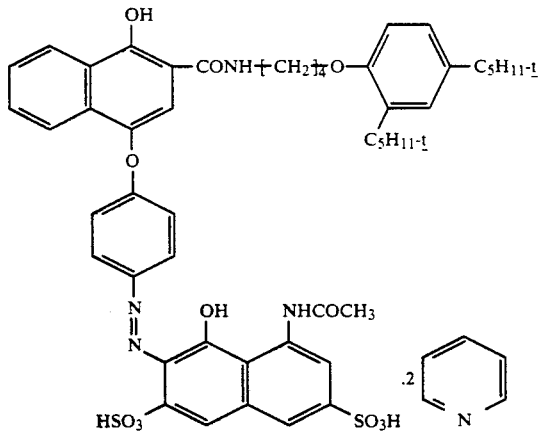
(8)
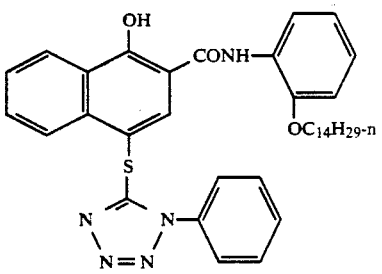

-continued
Coupler/Dye Structures
(9)
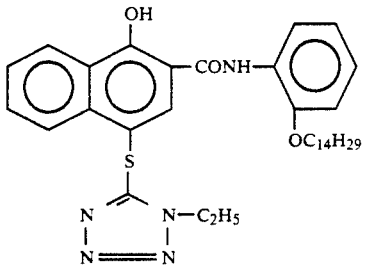
(10)
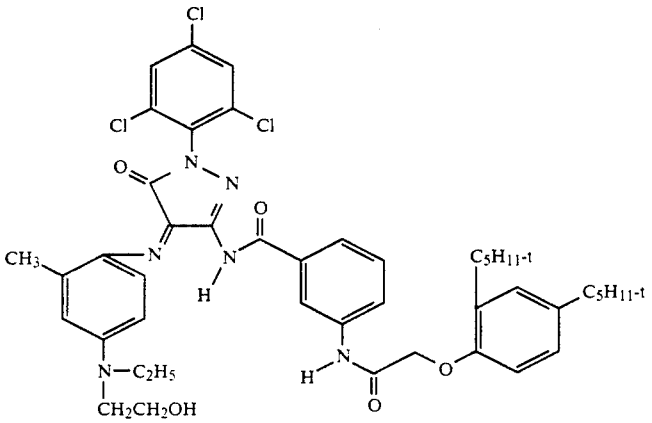
(11)
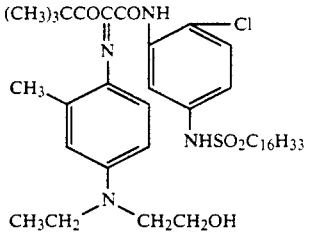
(12)
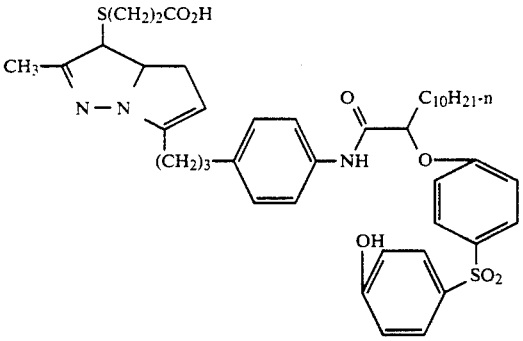
(13)
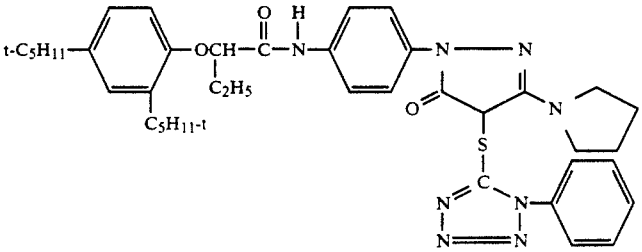

-continued
Coupler/Dye Structures
(14)
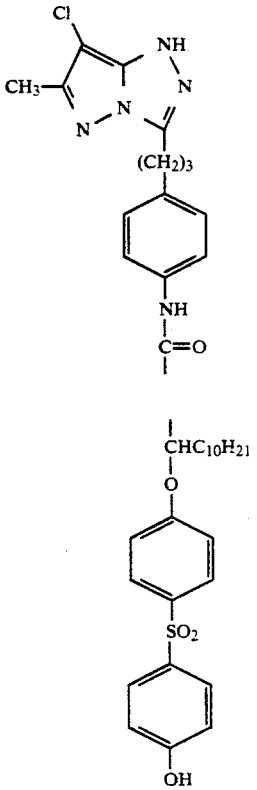
(15)
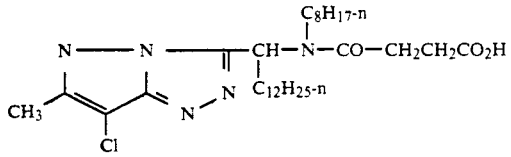
(16)
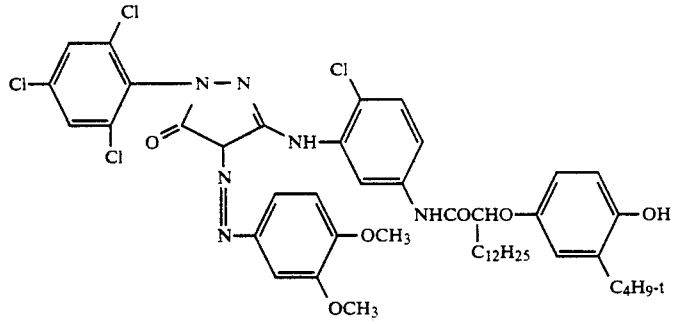
(17)
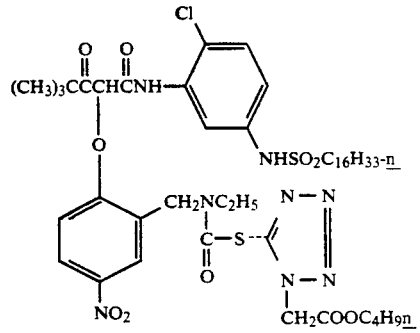

-continued

Coupler/Dye Structures (18)

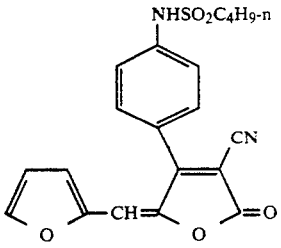

(19)

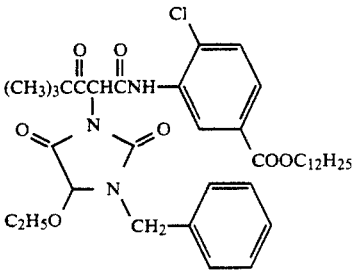

(20)

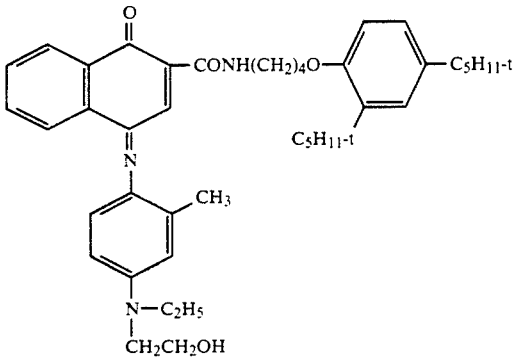

While the invention has been described in detail and with reference to specific embodiments thereof, it will be apparent to one skilled in the art that various changes and modifications can be made therein without departing from the spirit and scope thereof.

What is claimed is:

1. A method of making a photographic silver halide emulsion comprising precipitating and sensitizing a silver halide emulsion and adding to the silver halide emulsion after precipitation and before or during spectral/chemical sensitization an antifogging amount of a non-labile chalcogen compound represented by Formula I:

$$R^1—X^1—X^2—R^2 \quad \text{(Formula I)}$$

where $X^1$ and $X^2$ are independently S, Se, or Te; and $R^1$ and $R^2$, together with $X^1$ and $X^2$, form a ring system, or are independently substituted or unsubstituted cyclic, acyclic or heterocyclic groups.

2. The method of claim 1 wherein $R^1$ and $R^2$ are independently substituted alkyl or aryl groups; the dichalcogenide molecule is symmetrical and the molecular weight is greater than 210 g/mol.

3. The method of claim 1 wherein the dichalcogenide compound is a disulfide compound represented by Formula II or III:

(Formula II)

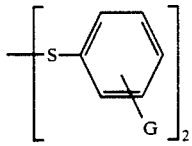

where G is independently in an ortho, meta, or para position on the aromatic nucleus relative to the sulfur and is hydrogen, hydroxy, $SO_3M$ or $NR^3R^4$;

M is hydrogen, or an alkaline earth, alkylammonium or arylammonium cation;

$R^3$ is hydrogen, or a substituted or unsubstituted alkyl or aryl group;

$R^4$ is hydrogen, O=C—$R^5$, or O=C—N—$R^6R^7$; and $R^5$, $R^6$, and $R^7$ are independently hydrogen, or hydroxy, or an unsubstituted alkyl, or aryl group, or a substituted or unsubstituted fluoroalkyl, fluoraryl, carboxyalkyl, carboxyaryl, alkylthioether, arylthioether, sulfoalkyl, or sulfoaryl group or the free acid, alkaline earth salt or alkylammonium or arylammonium salt of the aforementioned groups, (Formula III)

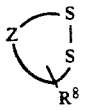

where Z contains substituted or unsubstituted carbon or hetero atoms sufficient to form a ring; and $R^8$ is a substituted or unsubstituted alkyl or aryl group of 2 to 10 carbon atoms, or the free acid, alkaline earth salt, arylammonium or alkylammonium salt of the aforementioned groups.

4. The method of claim 3 wherein the disulfide is represented by Formula II and the molecule is symmetrical and G is in an ortho, meta, or para position on the aromatic nucleus relative to the sulfur and is $NR^3R^4$; and $R^4$ is hydrogen or $O{=}C{-}R^5$.

5. The method of claim 4 wherein G is in a para position relative to sulfur, $R^3$ is hydrogen or methyl, $R^4$ is $O{=}C{-}R^5$ and $R^5$ is an alkyl group of 1 to 10 carbon atoms, an aryl group of 6 to 10 carbon atoms or a trifluoromethyl group.

6. The method of claim 5 wherein the disulfide compound is p-acetamidophenyl disulfide.

7. The method of claim 3 wherein the disulfide compound is represented by Formula III and $R^8$ is a substituted or unsubstituted carboxyalkyl, carboxyaryl, alkyl ester, or aryl ester group of 2 to 10 carbon atoms , or the free acid, alkaline earth salt, arylammonium or alkylammonium salt of the aforementioned groups.

8. The method of claim 7 wherein Z comprises carbon atoms sufficient to form a ring and $R^8$ is a substituted or unsubstituted alkyl or aryl group of 4 to 8 carbon atoms, or the free acid, alkaline earth salt, arylammonium or alkylammonium salt of the aforementioned groups.

9. The method of claim 8 wherein $R^8$ is a substituted or unsubstituted carboxyalkyl, carboxyaryl, alkyl ester, or aryl ester group of 4 to 8 carbon atoms, or the free acid, alkaline earth salt, arylammonium or alkylammonium salt of the aforementioned groups.

10. The method of claim 9 wherein the compound is 5-thioctic acid.

11. The method of claim 3 wherein the antifogging amount of the disulfide compound is $1\times10^{-7}$ to $1\times10^{-2}$ mol/mol Ag.

12. The method of claim 3 wherein the antifogging amount of the disulfide compound is $1\times10^{-5}$ to $3\times10^{-4}$ mol/mol Ag.

13. The method of claim 3 wherein the silver halide emulsion is a reduction sensitized emulsion.

14. The method of claim 3 wherein the silver halide emulsion is a silver bromoiodide emulsion sensitized with sulfur and gold.

15. The method of claim 3 wherein the compound is added as a solid particle dispersion.

16. The method of claim 3 wherein the silver halide emulsion is doped with a Group VIII metal.

17. A method of making a photographic silver halide emulsion comprising:

(a) precipitating a silver bromoiodide emulsion, sensitizing the bromoiodide emulsion with sulphur and gold; and adding to the emulsion after precipitation and before or during spectral/chemical sensitization $1\times10^{-7}$ to $1\times10^{-2}$ mol/mol Ag of a compound represented by (f) Formula II;

(Formula II)

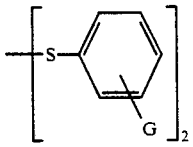

wherein G is in a para position to sulfur and is $NR^3R^4$, $R^3$ is hydrogen or methyl, $R^4$ is $O{=}C{-}R^5$ and $R^5$ is an alkyl group of 1 to 10 carbon atoms, an aryl group of 6 to 10 carbon atoms or a trifluoromethyl group.

18. The method of claim 17 wherein the amount of disulfide compound added is $1\times10^{-5}$ to $3\times10^{31\,4}$ mol/mol Ag.

19. The method of claim 17 wherein the disulfide compound is p-acetamidophenyl disulfide.

20. A photographic silver halide emulsion prepared by anyone of the methods described in claims 1 through 19.

* * * * *